United States Patent [19]

Fayfield

[11] Patent Number: 4,626,053

[45] Date of Patent: Dec. 2, 1986

[54] SENSING DEVICES WITH MODULAR INTERCONNECTION AND PROGRAMMING

[75] Inventor: Robert W. Fayfield, Excelsior, Minn.

[73] Assignee: Banner Engineering Corp., Minneapolis, Minn.

[21] Appl. No.: 612,663

[22] Filed: May 21, 1984

[51] Int. Cl.[4] ..... H01R 27/00

[52] U.S. Cl. ..... 339/32 M; 339/32 R

[58] Field of Search ..... 339/32, 33, 47 R, 147 R

[56] References Cited

U.S. PATENT DOCUMENTS

| | | | |
|---|---|---|---|
| 3,300,750 | 1/1967 | Harner et al. | 339/32 R |
| 3,341,801 | 9/1967 | Brookman et al. | 339/143 R |
| 3,418,621 | 12/1968 | Campbell, Jr. | 339/143 R |
| 4,405,190 | 9/1983 | Schroeder | 339/32 R |

FOREIGN PATENT DOCUMENTS

| | | |
|---|---|---|
| 401659 | 11/1933 | United Kingdom . |
| 408535 | 4/1934 | United Kingdom . |
| 484934 | 5/1938 | United Kingdom . |
| 747063 | 3/1956 | United Kingdom . |
| 799510 | 8/1958 | United Kingdom . |
| 821569 | 10/1959 | United Kingdom . |
| 1006549 | 6/1961 | United Kingdom . |
| 901727 | 7/1962 | United Kingdom . |
| 1155540 | 6/1969 | United Kingdom . |

*Primary Examiner*—Gil Weidenfeld
*Assistant Examiner*—Paula A. Austin
*Attorney, Agent, or Firm*—Merchant, Gould, Smith, Edell, Welter & Schmidt

[57] ABSTRACT

A sensing device constructed of two or more modules which can be connected together in different possible orientations to form a complete sensor. The modules have patterns of electrical contacts on adjacent faces such that different relative orientations of the modules effect interconnection of different contacts to program and select the mode of operation of the sensing device, from a plurality of available modes. In a preferred embodiment, a programming module having a connector bar is positionable between sense and control modules of the device in a plurality of different orientations to effect both programming mode selection and device orientation for mounting convenience.

12 Claims, 9 Drawing Figures

SENSING DEVICES WITH MODULAR INTERCONNECTION AND PROGRAMMING

TECHNICAL FIELD OF THE INVENTION

This invention relates generally to the field of non-contacting sensing devices, for example photoelectric, ultrasonic or inductive proximity sensors. In particular, the invention relates to a modular configuration for sensing devices having interconnection means for connecting two or more modules of the device and at the same time selecting the mode of operation thereof.

BACKGROUND OF THE PRIOR ART

Non-contacting sensing devices are widely used in a variety of industrial control systems for the detection or measurement of objects such as the movement of products, the motion or position of machine parts and the like. Such devices may be based upon photoelectric sensing, either visible or infrared, ultrasonic sensing, inductive proximity sensing, or other sensing techniques. Regardless of the physical principle relied on for sensing, such sensing devices are generally provided in housings which may be mounted and oriented in places and directions appropriate to the intended application.

For a number of reasons it is desirable to make the sensing device housing modular with two or more modules that may be interconnected together mechanically and electrically to form a complete sensing device. Typically the sensing head is made in a separate module. The sensing head would contain the actual sensing element, for example in the case of a photoelectric control, the sensing head would contain the light transmitting and/or receiving elements. Other functions would be housed in a further module, referred to here for convenience as a control module, to which the sensing head module would attach. The control module may contain other functions such as logic, power load switching, and the like, and it may in turn be broken up into separate modules for those functions. The modular approach offers an advantage in terms of minimizing inventory, as it permits a building block approach so that many different types of sensing heads can be installed on a single body or control module, depending upon specific applications. This greatly simplifies inventory problems, for the manufacturer, distributor and end user.

A further advantage of the modular approach is that it may permit positioning the sensing head on the control module in different directions for different applications. Typically the sensing device is in a generally rectangular housing and means may be provided so that the sensing head can be positioned oriented in any of four possible sensing directions. This permits the control module to be mounted in such a way that allows easy access to its wiring chamber or to adjustments for operating parameters, and the sensing head can be independently positioned to face forward, backward or to either side as required for the application.

SUMMARY OF THE INVENTION

This invention provides a modular construction for a sensing device which provides for selection of a mode of operation of the sensing device by selecting the relative orientation of two or more modules to be interconnected.

According to the present invention a modular sensing device includes at least a pair of modules each having an area which includes patterns of electrical contacts. The modules are configured to fit together with their electrical contact pattern adjacent each other, with the modules in any of a number of different relative orientations so as to effect interconnection of different ones of the patterns of electrical contacts. The patterns of electrical contacts connect to functional circuits in at least one of the modules in such a way as to select or program one of a plurality of modes of operation for the circuitry depending upon the relative orientation between the modules.

According to a preferred form of the invention a modular non-contact sensing device is provided in which one module includes the sensing head portion, and another module includes other control or output functions, at least one of these modules having more than one mode of operation. Both the sensing head module and the control module have areas having patterns of electrical contacts. A programming module is provided and is configured to fit between and in contact with the electrical contact pattern areas of the sensing head module and the control module, and to establish electrical connection between selected ones of the contacts of the sensing head module and control module contact patterns. The contacts of the programming module and the contacts of at least one of said contact pattern areas are arranged to effect selection of mode of operation by selection of the relative orientation of the programming module to make different connections. Means are provided for holding the sensing head module, progamming module and control module together in assembly with the program module in the selected orientation to make a complete sensing device operable in the selected mode of operation.

According to another aspect of the invention, the control module can be subdivided into separate functional modules such as logic module, power module and the like having contact patterns for mode selection, and additional programming modules can be provided therebetween and oriented into a plurality of different orientations for selection of further modes of operation.

According to another aspect of the invention one or more of the modules can be rotated to a desired orientation with respect to a mounting position or a sensing application, independently of and simultaneously with the mode selection controlled by orientation of a programming module.

DETAILED DESCRIPTION OF THE PREFERRED EMBODIMENT

Figure 1:
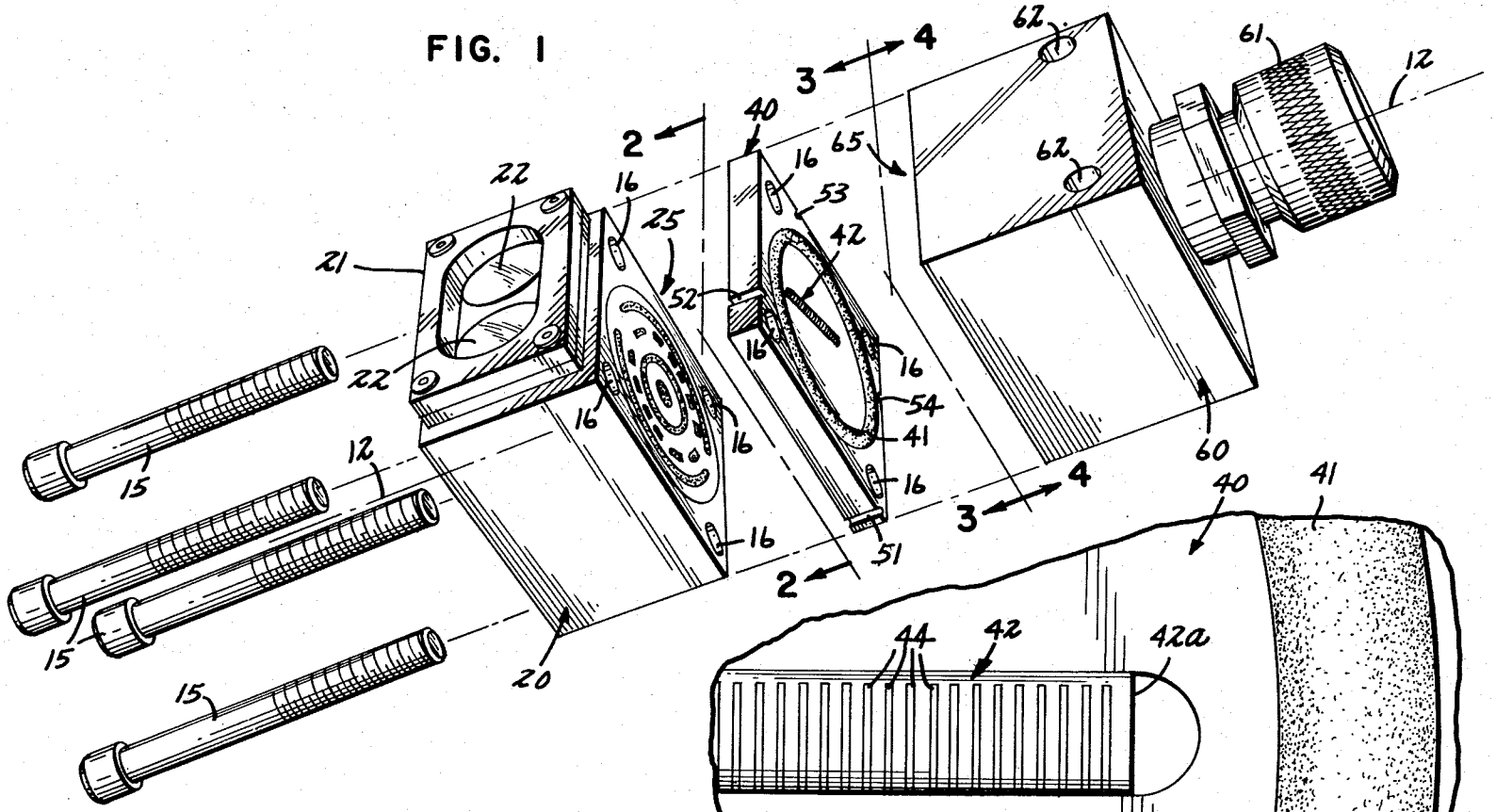
FIG. 1 is an exploded perspective view of a photoelectric embodiment of a sensing device according to the invention.
Figure 5:
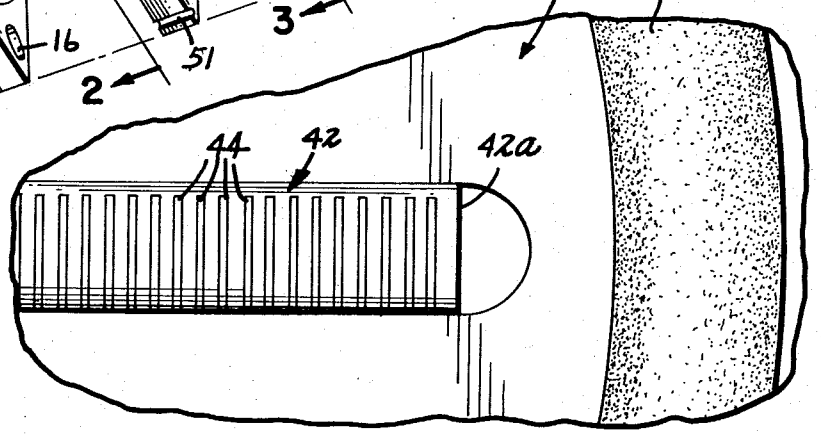
FIG. 5 is an enlarged fragmentary detail view of a portion of the interconnection and programming module of FIG. 3.

As mentioned above, the present invention is applicable to all types of non-contacting sensing devices, regardless of the nature of the physical principle used for sensing. For purposes of illustration, but not by way of limitation, the preferred embodiment herein is described in terms of a photoelectric sensor, commonly referred to as a photoelectric scanner.

The photoelectric scanner embodiment of FIGS. 1 through 5 includes a sensing head or module 20 which comprises a generally square sectioned block which contains light transmitting and/or receiving elements and electronic circuitry associated therewith. A bezel 21 is attached along one side thereof, and holds a pair of lens assemblies 22 used for focusing the light used for sensing. The embodiment shown has two such lens assemblies, and it will be understood that depending upon the particular sensing head, one or more lens assemblies would be used depending upon whether the sensing head is for transmit only, receive only, or combined transmit and receive for use with a retroreflector. Alternatively, multiple transmitting elements can be used as is known in the art, for providing operation in infrared or visible light, etc.

Along one side of sense module 20 there is provided a pattern of electrical contacts, indicated by reference number 25. This pattern is shown also in FIG. 2 and is described in greater detail below.

An interconnecting and programming module 40 is also provided and is designed to be placed in assembly adjacent the side of sense module 20 which has the electrical contact pattern 25. Programming module 40 is preferably formed of a block which preferably, although not necessarily, has a cross-sectional area the same as sense module 20. The thickness of program module 40 is not critical, but for purposes of keeping an overall compact size to the sensing device, it should be as thin as possible. As a practical matter, since program module 40 only contains connecting devices as discussed further below, it will generally be thinner than sense module 20 which generally contains a number of components. Programming module 40 is also shown in plan view in FIG. 3.

In the embodiment of FIG. 1, a third module indicated by reference number 60 is shown. This module may be referred to as the body portion, or the control or output module, etc. For purposes of convenience of terminology, module 60 will be referred to as the control module. It will be understood, however, that the actual function provided within module 60 will vary depending upon the design of the device, and in some cases may include a considerable number of control functions, while in other cases may serve primarily only as a support and connection for the sensing module. In the embodiment shown, control module 60 provides power to sense module 20 and also provides the output switching function. A connector 61 is provided in the base of control module 60 for connection to a cable to controlled devices as is generally known. Mounting holes 62 are provided in control module 60 as an aid in mounting the completed sensing device for a particular application. Alternatively, various types of mounting brackets, clips, retainers etc. can be used for that purpose.

Control module 60 is also preferably, but not necessarily, of the same cross-sectional shape as sense module 20 and program module 40. Control module 60 has a pattern of electrical connectors on one face thereof designed to contact program module 40 when assembled as a complete device. The electrical contact pattern for control module 60 is not visible in the orientation of FIG. 1, but is indicated by reference number 65, and is visible in FIG. 4.

Attachment means are provided for assembling the sense module 20, program module 40 and control module 60 together to form a sensing device, and to permit such assembly with a number of alternate orientations of the modules. In the preferred embodiment each of the modules has four bolt holes 16 passing therethrough, one positioned at each corner of the cross-sectional surface. These bolt holes line up when the unit is assembled, and bolts 15 pass therethrough to hold the device in assembly. The holes in control block 60 can either pass completely through, or there can be retained attachment nuts or other couplings within, to which bolts 15 can attach to secure the unit together. Preferably the heads of bolts 15 are accessible on the top of module 20, at the opposite end of the assembled device from connector 61, as this would be the most convenient location for access for field disassembly and assembly. It will be appreciated that any other type of attachment means for holding the modules together and permitting convenient disassembly and reassembly could be used as an alternative to bolts 15.

Referring to FIG. 1, it can be seen that by rotation of sense module 20 with respect to control module 60 (or vice versa) about central axis 12 it is possible to align the sensing optical axis of the scanner in different directions. Since the embodiment shown has a square cross section, four different orientations are possible, although other geometries and attaching means could be used for other choices of orientations. This feature can be used to provide a convenience in installation, for example in the event that control module 60 has an access door for wiring, timing adjustments or the like which require that it be mounted in a particular orientation for access. The sensing head can then be turned to the appropriate direction for the sensing application.

However, the present invention provides the capability not only of allowing choice of aiming direction of the sense module with respect to the control module, but also through the use of the programming feature of the invention provides a means for selection of a mode of operation of the device. This function is accomplished through the selective interconnection of selected ones of the contacts of patterns 25 and 65, depending upon the selected orientation of the program module 40.

Figure 2:
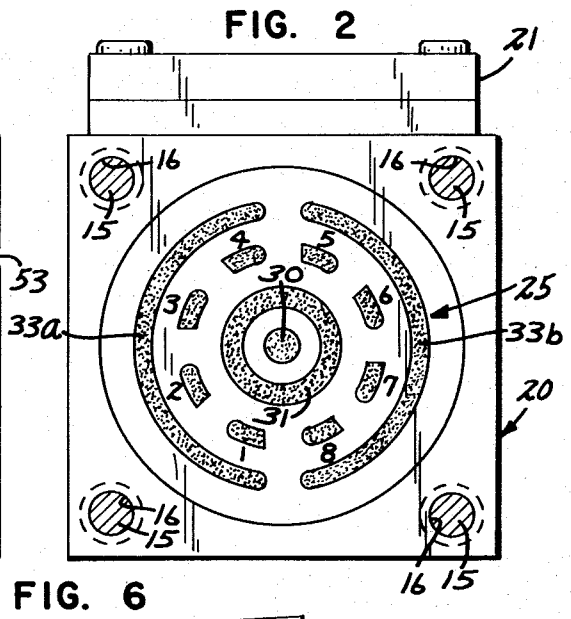
FIG. 2 is a plan view of the contact pattern of the sensing head module of the embodiment of FIG. 1, taken generally along line 2—2 of FIG. 1.
Figure 3:
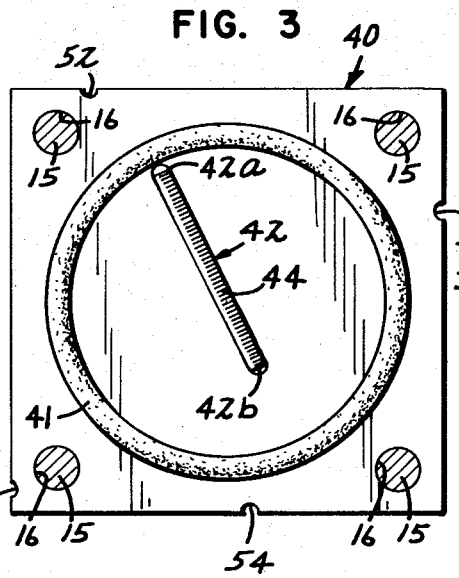
FIG. 3 is a plan view of the interconnection and programming module taken generally along line 3—3 of FIG. 1.
Figure 4:
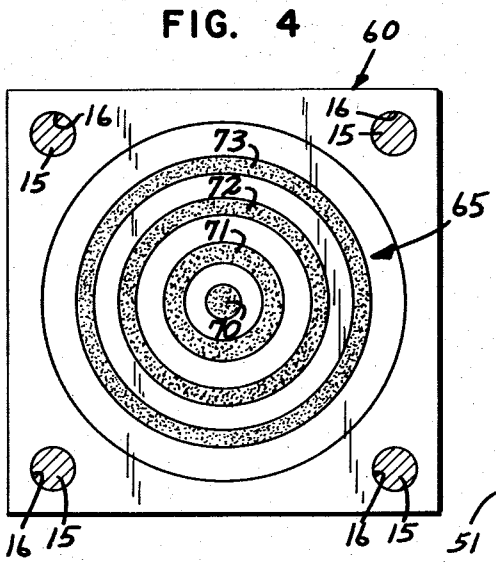
FIG. 4 is a plan view of the contact pattern on the control module, taken generally along line 4-4 of FIG. 1.

With reference to FIGS. 2, 3 and 4, one useful pattern arrangement from many possibilities is shown. FIG. 4 shows the conductor pattern 65 of control module 60. In the embodiment shown, this pattern consists of a central conductor 70, and three concentric circular conductive portions 71, 72 and 73, all of which are separated by non-conductive portions. A convenient way of making this pattern is to use a printed circuit board for that side of the module. This circuit board can advantageously be used as a mother board for holding other components and circuit boards on the interior of the module.

Electrical contact pattern 25 for sense module 20 is shown in FIG. 2. This likewise conveniently can be made as a printed circuit board, which can also serve as another board for components mounted within sense module 20. Pattern 25 in the preferred embodiment includes a central conductor 30, a concentric contact conductor 31, and a pair of further concentric contact circles that are broken up into segments. Contacts 1 through 8 are isolate segments of a concentric ring that would correspond in position to contact 72 of pattern 65. Contacts 33a and 33b are separated segments of a ring that would correspond in position to contact 73 of pattern 65.

Interconnect and programming module 20, as seen in FIGS. 1 and 3, has a contact bar 42 positioned generally in the area to contact patterns 25 and 65 of sense module 20 and control module 60. Contact bar 42 extends completely through the thickness of program module 40, so that both sides of program module 40 appear essentially the same. Contact bar 42 consists of a plurality of electrical connectors, the purpose of which is to provide electrical continuity from certain contacts of pattern 25 to certain contacts of pattern 65. Although various constructions for contact bar 42 can be used, the preferred embodiment uses an elastomer connector. This connector makes use of a conductive elastomer such as is available from commercial sources, consisting of an elastic non-conductive material having a number of independent paths of conductive material extending therethrough. This is suggested in FIG. 5 which shows a number of individual conductive paths, indicated by reference number 44. The individual conductive paths 44 are insulated from one another, but each extends from one surface of the program module to the opposite side. Preferably the body of program module 40 is made of plastic or some other nonconductive material, and a slot is formed therein which holds contact bar in place. The elastomeric contact bar 42 is slightly thicker than program module 40, so that it extends a distance outwardly from the surface on both sides of the module. This insures good contact with the conductive patterns on the other modules when the device is assembled with the program module sandwiched between the other modules. Program module 40 has seal rings 41 on both sides thereof which encircle the contact areas and serve as environmental seals to protect the contacts when the unit is assembled.

In the interconnect scheme of the preferred embodiment shown, one end of the contact bar designated by reference number 42*a* extends from the center out to the radius of contact 73 and contact segments 33*a*, 33*b*. The other end 42*b* of the contact bar extends out only to cover contacts 71 and 31.

When the device is assembled, contact bar 42 will interconnect contact 30 of sense module 20 and contact 70 of control module 60. Similarly, contacts 31 and 71 will be interconnected regardless of the angular orientation of the modules. However, which one of contacts 1–8 will be connected to contact 72, and which of contacts 33*a* and 33*b* will be connected to contact 73 depends on the relative angular orientation between sense module 20 and program module 40. Because contact bar 42 is placed at an angle of 22½ degrees with respect to an edge of the module, eight different orientations are possible for the square section embodiment shown. The program module can be put to four different directions with respect to the sense module, then it can be turned over to its opposite side and four more orientations are possible. In that manner each of the eight contacts 1–8 can be contacted.

Different geometries can be used for a greater number of contacts, but eight is sufficient for a wide range of applications. For example, contacts 30–70 and 31–71 can be used to connect power supply potentials from the control module to the sense head. Contacts 33*a* and 33*b* can be used to select whether the output is normally open (light operate) or normally closed (dark operate). For each of those modes, four modes can be selected by contacts 1–4 or 5–8, for example to select response time. Thus a choice of four different response times would be available in the light operate mode and four response times in the dark operate mode, depending simply upon the relative orientation between the programming module and the sense module. Alternatively, the programming feature could be used to select any other modes of operation, for example power level, visible versus infrared source, etc.

It will be appreciated that in the embodiment shown in FIG. 1, the mode selection takes place at the interface between the program module and the sense module, whereas the interface between the program module and the control module is used basically as a universal connection to allow the sense module program module combination to be rotated to a convenient orientation with respect to the control module for a given application. However, other arrangements are also possible. For example, by suitable arrangement of the contact patterns on the modules, mode selection or programming could take place between the control module and the programming module, with the rotation for convenience of orientation taking place between the program module and the sense module. The patterns could also be arranged so that mode selection takes place both at the interface to the control module and the interface to the sense module.

As a further convenience to the user of the device, indexing marks may be provided around the periphery of the program module, for cooperating with a legend on the sense module to indicate the selected mode. The reverse is also possible, with legends on the sides of the program module and an index mark on the sense module. In the embodiment shown, the index marks may be ridges or indentations 51–54. It will be noted that index mark 51 is relatively close to a corner, and index marks 52, 53 and 54 are progressively farther from their respective corners. Actually, eight positions of the index mark with respect to a reference corner are possible—the four positions apparent in FIG. 3, and four additional positions obtained by inverting the programming module to the other side. The index marks preferably extend across the full thickness of the programming module, so that they can be used regardless of which face of the program module is in contact with pattern 25.

Figure 6:
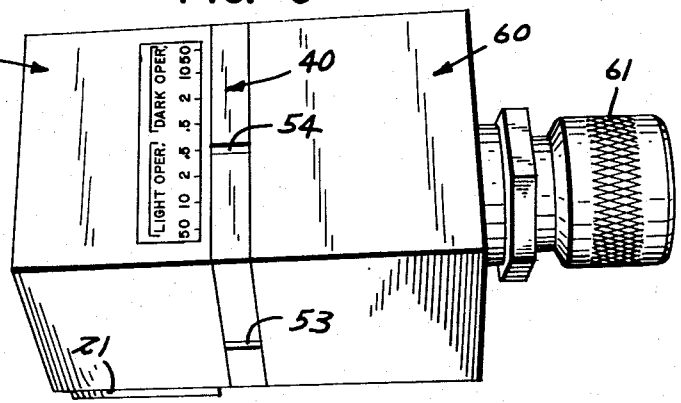
FIG. 6 is a perspective view of the embodiment of FIG. 1 in assembly showing the reverse side thereof.

As seen in FIG. 6, index mark 54 is aligned with the mode select legend "light oper., 0.5", meaning light operate mode, 0.5 millisecond response time. In installing the unit or in making subsequent field adjustments, all that is necessary is for the operator to try different orientations of the program module 40 to the sense module 20 until an index mark lines up with the desired mode of operation. Then holding the sense module and program module together in the desired orientation, both are rotated to the desired orientation with respect to control module 60 for convenience in mounting as explained above. Bolts 15 are then placed through the holes and secured or if some other attachment means is used it is secured to hold the assembly together.

Figure 7:
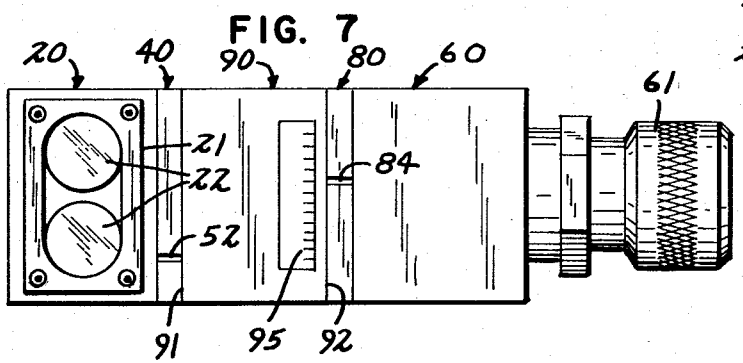
FIG. 7 is a plan view of an alternate embodiment of the invention using three modules separated by two interconnecting and programming modules.
Figure 8:
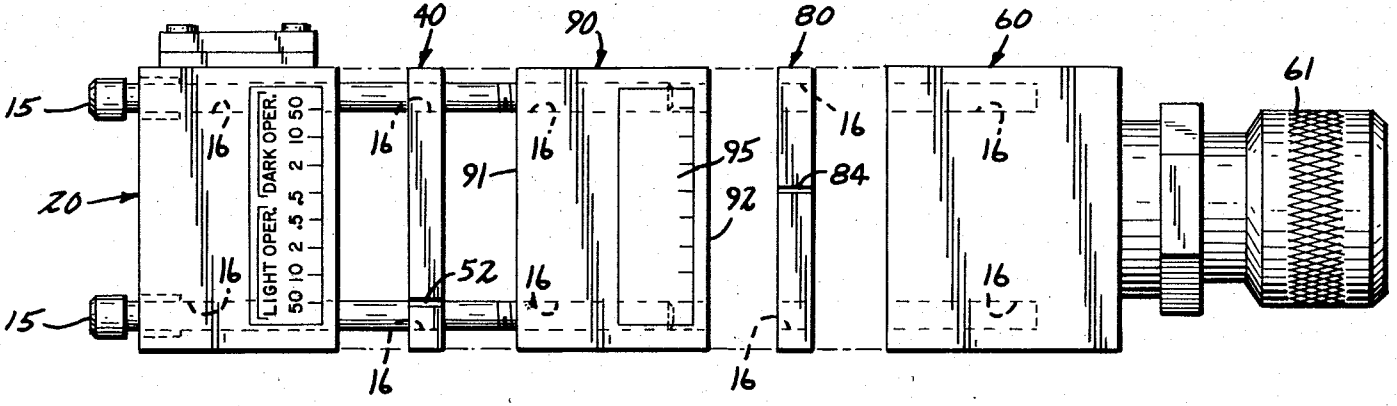
FIG. 8 is an exploded view at an enlarged scale of the device of FIG. 7.

FIGS. 7 and 8 show a further embodiment of the invention in which a pair of program modules are sandwiched between three function modules. Specifically, a sense module 20, a first program module 40, a logic module 90, a second program module 80 and a control module 60 are all sandwiched together in assembly. Sense module 20 and control module 60 may be the same as in the previous embodimemt, or they may be different for specific applications. Similarly, program modules 40 and 80 may be the same as in the previous embodiment, and for convenience in assembly and parts supply, they can be identical. Logic module 90 contains circuitry for providing a desired "logic" function as is generally known in the art. For example it may provide an "on delay" or "off delay" and selection of the length of the delay or other logic function as is generally known. Module 90 would carry power and control signals between sense module 20 and control module 60, and in addition would perform its selected logic function. Rather than having to provide different logic modules 90 for different functions, it too can be a multimode device with the programming or selection of the desired mode being accomplished by means of program module 80.

Preferably, face 91 of logic module 90 would have concentric ring conductors essentially the same as FIG. 4. Face 92 thereof would have segmented conductive patterns the same as, or generally similar to those of FIG. 2. In this preferred embodiment, the interface between sense module 20 and program module 40 would be a "mode select" interface using a pattern like FIG. 2; the interface between program module 40 and logic module 90 would be a "universal type" connection using a pattern such as FIG. 4; the interface between logic module 90 and program module 80 would be a "mode select" contact using a pattern similar to that of FIG. 2; and the interface between program module 80 and control mode 60 would be a "universal type" contact similar to FIG. 4. A mode select legend 95 is provided on logic module 90, and cooperates with an index mark 84 (corresponding to index marks 51 through 54 of FIG. 3) to indicate the selected mode in a manner similar to that which has previously been described with reference to FIG. 6.

By suitable design of the electronics, logic module 90 can be made optional. It can be left out if it is not needed or one of possibly several different logic modules can be put in if needed. Alternatively, if logic module 90 were not needed for a given application and it were necessary to maintain the same physical size of the finished device, an extra thick logic module or a dummy module could be used. Choice of orientation of the programming modules allows selection of modes both for the sense head and the logic module, while the two commutating type contacts allow flexibility in orientation for mounting while still having access to a desired face of control module 60 and/or logic module 90.

Figure 9:
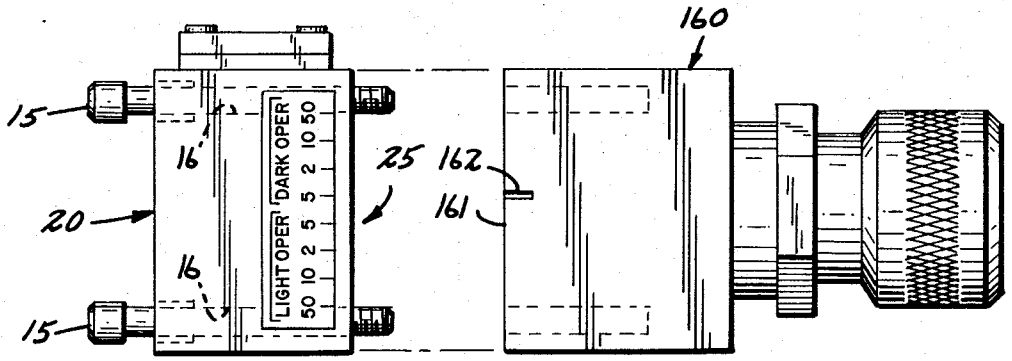
FIG. 9 is a view similar to FIG. 8 of a two module embodiment of the invention.

A simplified embodiment of the invention is shown in FIG. 9, which is a two module sensor without a separate programming module per se. In this simplified embodiment, the programming contact selection takes place between the two modules, and the "universal" type contacts are omitted. The two module embodiment of FIG. 9 includes a sensing module 20, which may be identical to the sense module of the previous embodiments, and a control module 160. Sensing module 20 may include an electrical contact pattern 25 for selecting an operational mode of sense module 20 as in the previous embodiments. Control module 160 may include on its face 161 a contact bar 42 similar to that previously described, or some other type of electrical contact array for making contact with selected ones of the patterns of contacts 25, depending upon the relative orientation between modules 20 and 160. A series of index marks such as 162 can be provided on the sides of control module 160 for visual confirmation of the selected operating mode, in a manner similar to that previously described. Alternatively, the arrangement can be reversed with the programming contact pattern being placed on the control module and the contacting bar placed on the sensing module.

The two module embodiment of FIG. 9 retains the programming feature but dispenses with the "universal" rotation feature for convenience in mounting, and can provide a simplified and lower cost alternative for applications where this latter feature is not required.

While the preferred embodiment of the invention has been described with respect to a square sectioned device and program module, it will be appreciated that other configurations can be used within the scope of the invention. Any shape could be used without limitation on number of sides, and including cylindrical also, depending upon the number of positional increments desired to accomplish the contact switching for a given application. The selection of number, pattern and type of contacts can be varied according to the electrical connection requirements for mode selection in a given application.

Similarly, while the preferred embodiment has been described with respect to a separate programming module having the same exterior dimensions as the modules to which it interconnects, it is also possible to have the programming module smaller to fit within a well or recess area formed in the end of an adjacent module while still performing the function of interconnecting selected contacts of adjacent modules. It will also be appreciated that any type of electrical contacts can be used within the scope of the invention. For example, metallic spring-contact type brushes could be used instead of the elastomer connector of the preferred embodiment top make contact with the printed circuit board contact patterns. Alternatively, any type of electrical connectors can be provided on the modules to achieve the same result.

What is claimed is:

1. A sensing device for the detection or measurement of objects, comprising:

a direction dependent sense module having means for sensing objects within a sensitivity pattern along a predetermined sensing direction relative to said sense module, said sense module having a pattern of fixed electrical contacts thereon which connect to circuitry within the sense module;

a second module having a pattern of fixed electrical contacts thereon which connect to circuitry within the second module;

at least one of said sense module and said second module capable of operating in a plurality of discrete modes in response to connections to be made to its pattern of electrical contacts;

said sense module and said second module configured to fit together in a plurality of predetermined discrete orientations with said sensing direction rotated relative to said second module and with selected ones of the contacts of said sense module and said second module making electrical contact in different orientations of the modules to effect selection of one of said discrete modes of operation of said sense module or second module; and means for holding said sense module and second module together in assembly in each of said plurality of orientations to form a sensing device operative in the selected mode according to the relative orientation of the modules.

2. A sensing device for the detection or measurement of objects comprising:

a direction dependent sense module having means for sensing objects disposed generally along a sensing axis, said sensing module having a pattern of fixed electrical contacts thereon which connect to circuitry within the sensing module;

a second module having a pattern of fixed electrical contacts thereon which connect to circuitry within the second module;

at least one of said sensing module and said second module capable of operating in a plurality of discrete modes in response to connections to be made to their patterns of electrical contacts;

a programming module having electrical contacts thereon and configured to fit between said sensing module and said second module in a plurality of discrete orientations with respect to at least one of said modules, with the electrical contacts of the programming module in contact with the contact patterns of said sensing module and said second module to establish electrical connection between selected contacts thereof to effect selection of one of said discrete modes of operation of at least one of said sensing and second modules; and means for holding the sensing module, program module and second module together in assembly in each of said plurality of discrete orientations to make a sensing device with the sensing axis in the selected direction and operative in the selected mode according to the relative orientation of the modules.

3. A sensing device according to claim 2 wherein the pattern of electrical contacts on one of said sensing module or second module is independent of relative orientation thereof to thereby provide for rotation for convenience of mounting of the sensing device without affecting mode selection.

4. A sensing device according to claim 2 including a third module having a pattern of electrical contacts thereon which connect to circuitry within the third module, a further pattern of electrical contacts on said second module connected to circuitry therein, and a second programming module having electrical contacts thereon and configured to fit between said second and third modules in more than one orientation with respect to at least one of said modules, with the electrical contacts of said second programming module in contact with the contact patterns of said second and third modules to establish electrical connection between selected contacts thereof to effect further mode selection of at least one of said second and third modules, and wherein said holding means are configured to hold all modules in assembly in the selected orientations according to the selected modes of operation.

5. A sensing device according to claim 2 further including:

a third module having a pattern of fixed electrical contacts thereon which connect to circuitry within the third module, at least one of said second module and said third module capable of operating in a plurality of discrete modes in response to connections to be made to their patterns of eleetrical contacts;

a second programming module having electrical contacts thereon and configured to fit between said second module and said third module in a plurality of discrete orientations with respect to at least one of said second module and said third module, with the electrical contacts of the second programming module in contact with the contact patterns of said second module and said third module to establish electrical connection between selected contacts thereof to effect selection of one of said discrete modes of operation of at least one of said second and said third modules; and means for holding said second module, second program module and third module together in assembly in each of said plurality of discrete orientations according to the selected mode of operation.

6. A sensing device according to claim 2 wherein said programming module includes a contact bar providing a plurality of electrical paths from one side through to the other side thereof.

7. A sensing device according to claim 6 wherein said contact bar is made of conductive elastomer material.

8. A sensing device for the detection or measurement of objects, comprising:

a direction dependent sense module having means for sensing objects disposed generally along a sensing axis, said sensing module having a pattern of fixed electrical contacts on one side thereof, and having circuitry within the sensing module capable of operating in a plurality of discrete modes of operation in response to connections to be made to said electrical contacts;

a second module having a pattern of fixed electrical contacts on one side thereof which connect to circuitry within the second module;

a programming module configured to fit between said sensing module and said second module in a plurality of discrete orientations with said programming module rotated relative to said sensing module, said programming module having a plurality of electrical contacts thereon positioned to establish electrical contact between selected ones of the contacts of said sensing module and said second module depending upon the relative orientation thereof with contact made at each of said plurality of discrete orientations corresponding to one of said plurality of discrete modes to effect mode selection of said sensing module; and means for holding the sensing module, program module and second module together in assembly in each of said plurality of discrete orientations to make a sensing device with the sensing axis in the selected direction and operative in the selected mode according to the relative orientation of the program module to the sensing module.

9. A sensing device according to claim 8 wherein the pattern of electrical contacts on said second module is independent of relative orientation thereof with respect to said programming module, to thereby provide for rotation for convenience of mounting of the sensing device without affecting mode selection.

10. A sensing device according to claim 8 further including:

said second module including a further pattern of electrical contacts on a second side thereof;

a third module having a pattern of fixed electrical contacts on one side thereof which connect to circuitry within said third module;

at least one of said second and third modules capable of operating in a plurality of discrete modes of operation in response to connections to be made to its patterns of electrical contacts;

a second programming module configured to fit between said second module and said third module in a plurality of discrete orientations with said second programming module rotated relative to at least one of said second and third modules, said second programming module having a plurality of electrical contacts thereon positioned to establish electrical contact between selected ones of the contacts on said second side of said second module and said third module depending on the relative orientation thereof, with contact made at each of said plurality of discrete orientations corresponding to one of said plurality of discrete modes to effect mode selection; and means for holding the second programming module and third module together in assembly with said second module, sensing module and first programming module in each of said plurality of discrete orientations according to the selected mode of operation.

11. A sensing device according to claim 8 wherein said sensing module and said programming module are square in cross section, wherein said plurality of electrical contacts of said programming module are in the form of an elongate contact bar aligned approximately 22½ degrees with respect to the possible orientations of the programming module, so that eight different orientations of the sensing module and programming module are possible in assembly.

12. A sensing device according to claim 11 further including reference marks on the edges of said sensing module and program module to indicate by alignment thereof the selected mode of operation.

* * * * *